US008033072B2

(12) United States Patent
McClintick

(10) Patent No.: US 8,033,072 B2
(45) **Date of Patent: *Oct. 11, 2011**

(54) ROOFING SYSTEM AND METHOD

(75) Inventor: Edward Lee McClintick, San Antonio, TX (US)

(73) Assignee: Building Materials Investment Corporation, Wilmington, DE (US)

( * ) Notice: Subject to any disclaimer, the term of this patent is extended or adjusted under 35 U.S.C. 154(b) by 1062 days.

This patent is subject to a terminal disclaimer.

(21) Appl. No.: 11/686,791

(22) Filed: Mar. 15, 2007

(65) Prior Publication Data

US 2007/0151171 A1 Jul. 5, 2007

Related U.S. Application Data

(63) Continuation-in-part of application No. 11/224,537, filed on Sep. 12, 2005, now Pat. No. 7,448,177.

(60) Provisional application No. 60/609,391, filed on Sep. 13, 2004.

(51) Int. Cl.
*E04D 1/34* (2006.01)

(52) U.S. Cl. ..... 52/551; 52/748.1

(58) Field of Classification Search ..... 52/543, 52/547, 548, 549, 550, 551, 506.05, 506.01, 52/747.11, 747.1, 748.1
See application file for complete search history.

(56) References Cited

U.S. PATENT DOCUMENTS

| | | | |
|---|---|---|---|
| 1,358,863 | A | 11/1920 | McConnell |
| 1,447,290 | A | 3/1923 | Fischer |
| 2,097,845 | A | 11/1937 | Snow |
| 2,114,362 | A | 4/1938 | Tashjian |
| 2,205,307 | A | 6/1940 | Parsons |
| RE24,246 | E | 12/1956 | Fink et al. |
| 3,252,257 | A | 5/1966 | Price et al. |
| 3,292,334 | A | 12/1966 | Craig |
| 3,624,975 | A | 12/1971 | Morgan et al. |
| 3,746,378 | A | 7/1973 | Meyer |
| 3,803,792 | A | 4/1974 | Fulton |
| 3,885,075 | A | 5/1975 | Ferrante |
| 3,894,376 | A | 7/1975 | Shearer |
| 4,078,349 | A | 3/1978 | Gantner |
| 4,610,902 | A | 9/1986 | Eastman et al. |
| 4,671,036 | A | 6/1987 | Sullivan |
| 4,680,909 | A | 7/1987 | Stewart |
| 4,694,716 | A | 9/1987 | Sakamoto |
| 5,086,552 | A | 2/1992 | Moore |
| 5,228,264 | A | 7/1993 | Whitman |
| 5,258,222 | A | 11/1993 | Crivelli |

(Continued)

FOREIGN PATENT DOCUMENTS

AU 9888345 A * 4/1999

(Continued)

OTHER PUBLICATIONS

Declaration of Edward Lee McClintick dated May 15, 2007.

(Continued)

*Primary Examiner* — Brian E Glessner
*Assistant Examiner* — Adriana Figueroa
(74) *Attorney, Agent, or Firm* — Baker & McKenzie LLP

(57) ABSTRACT

Systems for assembling and supporting roofing members on a roof structure are described. An exemplary system includes at least one batten extending along a portion of the roof structure. The batten includes receiving portions for removably securing hanger devices along the batten. Related methods for support and assembly are also described.

19 Claims, 14 Drawing Sheets

U.S. PATENT DOCUMENTS

| | | | | | |
|---|---|---|---|---|---|
| 5,457,924 | A | | 10/1995 | Fujii et al. | |
| 5,527,409 | A | | 6/1996 | Lanphier | |
| 5,570,553 | A | | 11/1996 | Balkins | |
| 5,577,360 | A | | 11/1996 | Gibbs | |
| 5,615,523 | A | | 4/1997 | Wells et al. | |
| 5,642,596 | A | | 7/1997 | Waddington | |
| 5,791,112 | A | | 8/1998 | Plum | |
| 6,052,961 | A | * | 4/2000 | Gibbs | 52/518 |
| 6,125,592 | A | * | 10/2000 | Hickey et al. | 52/543 |
| 6,148,578 | A | | 11/2000 | Nowacek et al. | |
| 6,237,288 | B1 | | 5/2001 | Jenkins et al. | |
| 6,470,642 | B1 | * | 10/2002 | Eads | 52/518 |
| 6,516,572 | B1 | | 2/2003 | Nowacek et al. | |
| 6,586,353 | B1 | | 7/2003 | Kiik et al. | |
| 6,619,006 | B1 | | 9/2003 | Shirota | |
| 6,673,432 | B2 | | 1/2004 | Kiik et al. | |
| 6,708,456 | B2 | | 3/2004 | Kiik et al. | |
| 6,990,779 | B2 | | 1/2006 | Kiik et al. | |
| 7,444,790 | B2 | | 11/2008 | Hick | |
| 2004/0148898 | A1 | | 8/2004 | Hick | |
| 2004/0244156 | A1 | | 12/2004 | Jackson, Jr. et al. | |
| 2006/0096218 | A1 | | 5/2006 | Johnson | |

FOREIGN PATENT DOCUMENTS

| | | | | |
|---|---|---|---|---|
| EP | 497690 | A1 | * | 8/1992 |
| EP | 1035266 | A1 | * | 9/2000 |
| GB | 283027 | | | 1/1928 |
| GB | 392118 | | | 5/1933 |
| GB | 640776 | | | 7/1950 |
| GB | 1438485 | | | 6/1976 |
| GB | 2131060 | | | 6/1984 |
| GB | 2249565 | A | * | 5/1992 |
| JP | 2204556 | | | 8/1990 |
| JP | 6322898 | | | 11/1994 |

OTHER PUBLICATIONS

Slate Direct, Installation Guide, Slate 2.0 Roofing System.

* cited by examiner

ROOFING SYSTEM AND METHOD

CROSS-REFERENCE TO RELATED APPLICATIONS

This application is a continuation-in-part of U.S. application Ser. No. 11/224,537, filed Sep. 12, 2005, which claims priority to U.S. Provisional Application Ser. No. 60/609,391 filed Sep. 13, 2004. U.S. application Ser. No. 11/224,537 and U.S. Provisional Application Ser. No. 60/609,391 are incorporated herein by reference in their entirety for all purposes.

TECHNICAL FIELD

Applicant's invention relates to roofing for buildings, and more specifically to a slate roofing system and method of installation.

BACKGROUND

Slate roofs are appreciated for their aesthetic and durable qualities. Slate is one of the finest roofing materials available and has several advantages over asphalt shingle roofs. For example, state roofing is fireproof, resists hail damage, and often has a service life of 100 years or more. However, slate is a rigid natural stone product which unfortunately can be damaged by stress. Stress can be introduced into slate in several ways, but the most common cause of stress to slate is nails used to attach the slate to the roof deck. With nail installation, the nails need to be fastened so the slate hangs on the nail. If the nail is inserted too tightly, the nail will pinch the slate. On the other hand if the nail is not inserted deep enough, the overlapping piece of slate may crack from the hidden pressure point. Environmental effects on the wood decking and nails may also contribute to the stress. Environmental changes such as swings in temperature and humidity can cause the decking to expand and contract. If the nails are in a bind in this situation, the slate can crack or fall.

Furthermore, slate roofs are quite expensive (typically two to three times more expensive than composition asphalt roofing), and the weight of the slate is quite high compared to composition shingles (which may require additional support for the roof, further adding cost). Slate materials are expensive themselves, so any reduction in the amount of slate necessary for effective roofing would lead to both a decrease in cost and weight of a roof.

A good background for slate roofing and the method for installing the same may be found in the NRCA Roofing and Waterproofing Manual—4th Edition, pp. 1179-1227, that document being incorporated herein by reference. Typical slate roofs are constructed such that a wood roof is first covered with an underlayment layer, typically asphalt felt paper. Overlapping slate courses are then applied with slate covering the roof in two plies except where there is overlap, in which case there are three plies of slate. Through joints should not occur from the slate roof surface to the felt. So using the conventional slate roofing technique, slate tiles must be elongated sufficiently to allow for three-ply overlap (and two plies of slate on the exposed portions of the roof) in order to ensure that water cannot penetrate the roof between the seams between slate tiles. Accordingly, the conventional slate roofing technique requires the use of a great deal of slate material, due to the need for double ply coverage and three-ply overlap for water resistance, greatly increasing the cost and weight of a slate roof.

Slate roofs may be improved by reducing the amount of slate used to create a waterproof roofing surface, and by eliminating the use of nails (or any other penetration or system requiring a hole in the slate) to secure the slate tiles in place on the roof. This may allow for a more durable, but less expensive and heavy, slate roof. Furthermore, the slate roof would be more durable if there was some means of resisting uplift forces generated by winds on the slate tiles. High winds may catch under the leading edge of the slate tiles, applying a lifting force to the slate. In this manner, wind may increase stresses on the slate tiles. In addition, the wind may actually lift the slate tiles, exposing the underlying roof to the elements. Thus, an improved slate roofing system would attach the slate tiles to the rook deck using some means that would resist wind uplift forces, providing a more durable and weather resistant roof.

SUMMARY

The embodiments of the present disclosure include a roof having slate members attached by battens and hangers. The slate tiles are typically attached to the roof in overlapping rows. Underlayment may be attached to the roof, positioned below the battens. In some embodiments, battens are attached to the roof, stretching across the length of the roof and spaced vertically at regular intervals upon the roof. The hangers may then attach to the battens in order to support slate tiles, thereby affixing the slate tiles to the roof. Generally, the hangers could either be removably secured to the battens and/or secured to the battens in such a way as to be repositionable along the length of the battens. In some embodiments, the hangers are generally tension sprung to resist uplift. Accordingly, the hangers help the slate tile they support to resist uplift forces generated by wind. Additionally, the hangers may help the slate tiles of the lower row to resist uplift by pressing down across the top portion of the slate tiles (on the overlap section). In essence, the overlapping nature of the slate rows allows the hangers to maximize resistance to uplift.

The roof may further include interlayment material (often referred to as "slate liner") underlying the slate. Generally, slate liner associated with each row of slate underlies the slate tiles of a row. Typically, the slate liner for a row of tile would be positioned atop the hangers associated with that row, and the slate tiles would then be placed in the hangers atop the slate liner. In addition, the roof may include valley metal, gable/rake edge metal and drip edge metal positioned on the roof deck. Generally, the slate roof may be installed by positioning and attaching the battens to a roof deck. The hangers would then be secured to the battens, positioned on the battens in order to properly support slate tile across the roof. In one embodiment, the battens would have regularly spaced hanger holders or slots along their length, shaped and sized to accept the hangers. The hangers are operable to fit securely within the hanger holders, such that the hangers could be securely attached as necessary along the length of the battens to affix slate tiles to the roof. By providing hangers that are removably secured to the battens, the hangers may be appropriately positioned, regardless of an edge or a valley in the roof. An alternative embodiment might have hangers that are repositionable along the length of the battens, so that the hangers may be properly positioned, regardless of an edge or valley. Once the hangers have been appropriately placed on the battens, the state liner would be positioned atop the hangers before placing down the slate. In addition, underlayment may be placed below the battens, with a self-adhering membrane placed below the underlayment.

By underlaying each course of slate with an interlayment material layer, the interlayment material acts as a base to the through joints, preventing water penetration to the underlying roof through seams in the slate tiles. This can reduce the amount of slate used to form a waterproof roof by approximately 40% to 50% (since the interlayment material blocks water seepage through seams between slate tiles, less slate overlap is required to provide a waterproof roof. Rather than two plies of exposed slate and three-plies of slate at areas of overlap, the present embodiments use only a single ply of exposed slate with two-plies of slate at areas of overlap). Generally, heavy-duty, weatherproof interlayment material layer would be used, typically plastic 20 to 60 mil in thickness. Moreover, where slate meets side to side (the through joint), the underlaying interlayment material provides sufficient waterproofing to protect the roof. The interlayment material is also less expensive and lighter weight than the slate it replaces. Thus, disclosed embodiments improve upon prior art slate roofs by providing for a markedly improved weather barrier, lighter weight, and more economical slate roof.

Disclosed hanger embodiments do not require nails to mount the slate on the roof, improving the durability of the slate tiles by reducing stresses. The disclosed embodiments allow a plurality of hangers to be installed at one time. Since damage can also be caused during roof construction, the installation of a plurality of hangers at one time allows the slate to be installed from the top down. In addition, the nature of the hangers allows the roof to be easily repaired without tools. The metal used in some embodiments of the hangers can also be a more durable means of attachment of slate tiles to the roof, since the hanger shape provides for strong, durable attachment. The hangers are also generally spring tempered, which helps them spring against the roof deck. By being tension-sprung, the hangers may provide superior wind uplift protection.

While examples in this application make specific reference to slate and slate installation, the invention and techniques provided herein apply to tile and tile installation regardless of material, and any sort of shingle, as well.

DETAILED DESCRIPTION OF EMBODIMENTS

Figure 1:
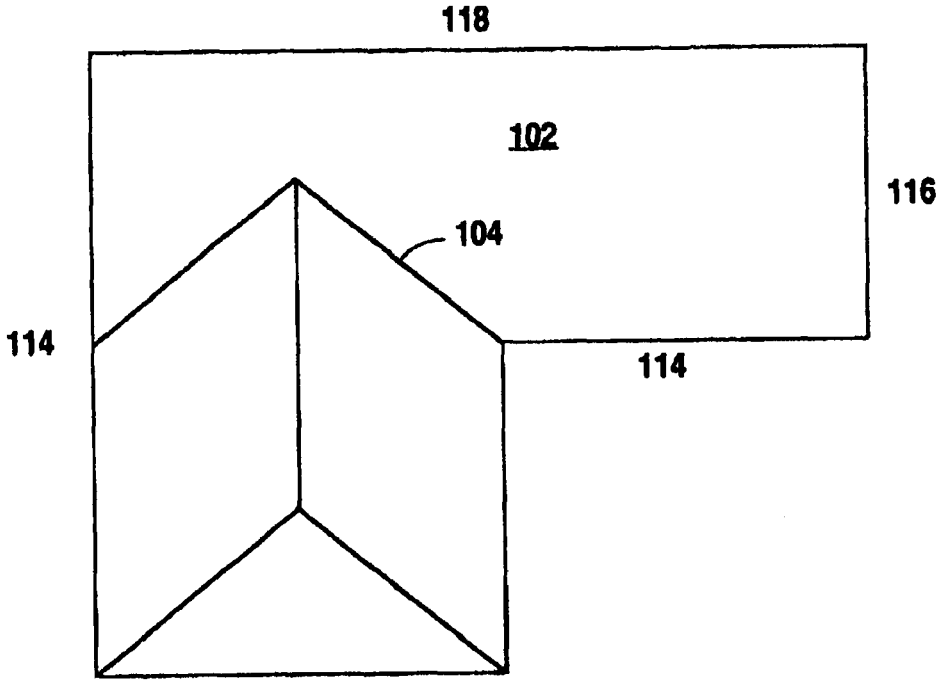
FIG. 1 is a top view of a roof deck.

In FIG. 1 a top view of a roof deck 102 is shown. In the present methodology, the initial step is to inspect and prepare the roof deck 102. In one embodiment, the roof deck 102 has a valley 104, eave 114, gable/rake 116 and ridge 118. In this exemplary roof deck 102 inspection step, the existing roof sheathing is inspected for structural integrity. The roof deck 102 should be preferably minimum 15/32 inch plywood or code approved oriented strand board (OSB). All roof deck 102 nails should be driven flush with the roof deck 102. The roof deck 102 should be inspected for protrusions which may damage felt underlayment 110 (See FIG. 3).

Figure 2:
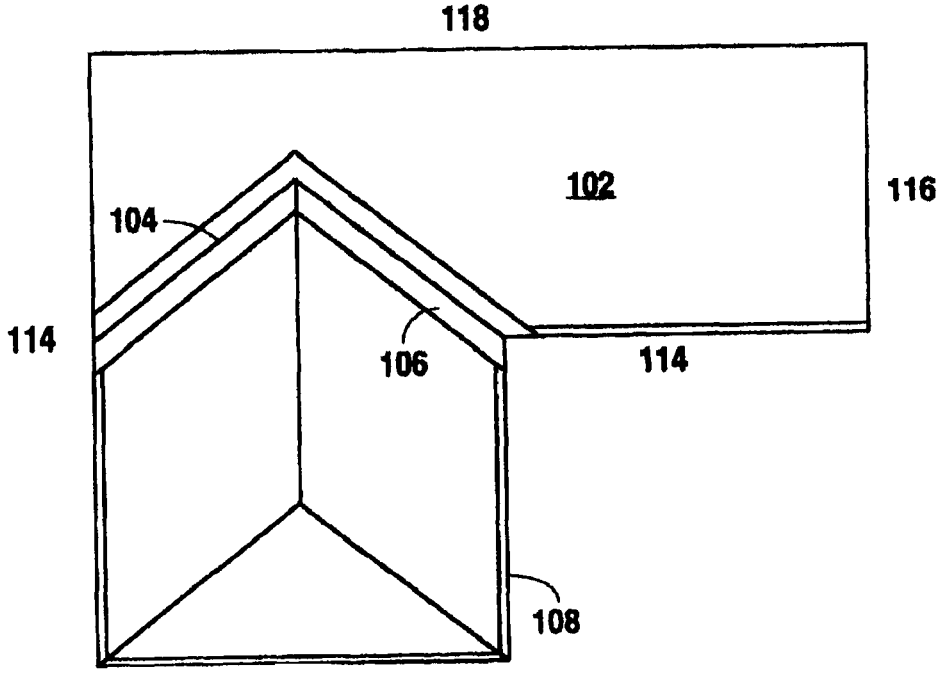
FIG. 2 is a top view of the roof deck illustrating valley preparation and drip edge installation.

FIG. 2 is a top view of the roof deck 102 illustrating valley 104 preparation and drip edge 108 installation. In this step of the present methodology, the user installs peel and stick membrane 106 in the valleys 104 while overlapping membrane 106 seams a preferred minimum of six inches. The membrane 106 used is preferably a self-adhering poly(styrene-butadiene-styrene) (SBS) type. For example, the membrane 106 used in the preferred embodiment is Tarco™ Leak Barrier Ice and Water Armor. However, it is to be appreciated that any equivalent membrane can be utilized. The membrane 106 is preferably 36 inches wide. All drip edge 108 metals are then installed. The drip edge 108 is preferably D style No. 26 gauge galvanized or 16 ounce copper metal. On new construction, if the exterior fascia board has not been painted, the drip edge 108 may be delayed and installed after the underlayment 110 (See FIG. 3) is installed. The underlayment 110 (See FIG. 3) should extend over the drip edge 108 metal.

Figure 3:
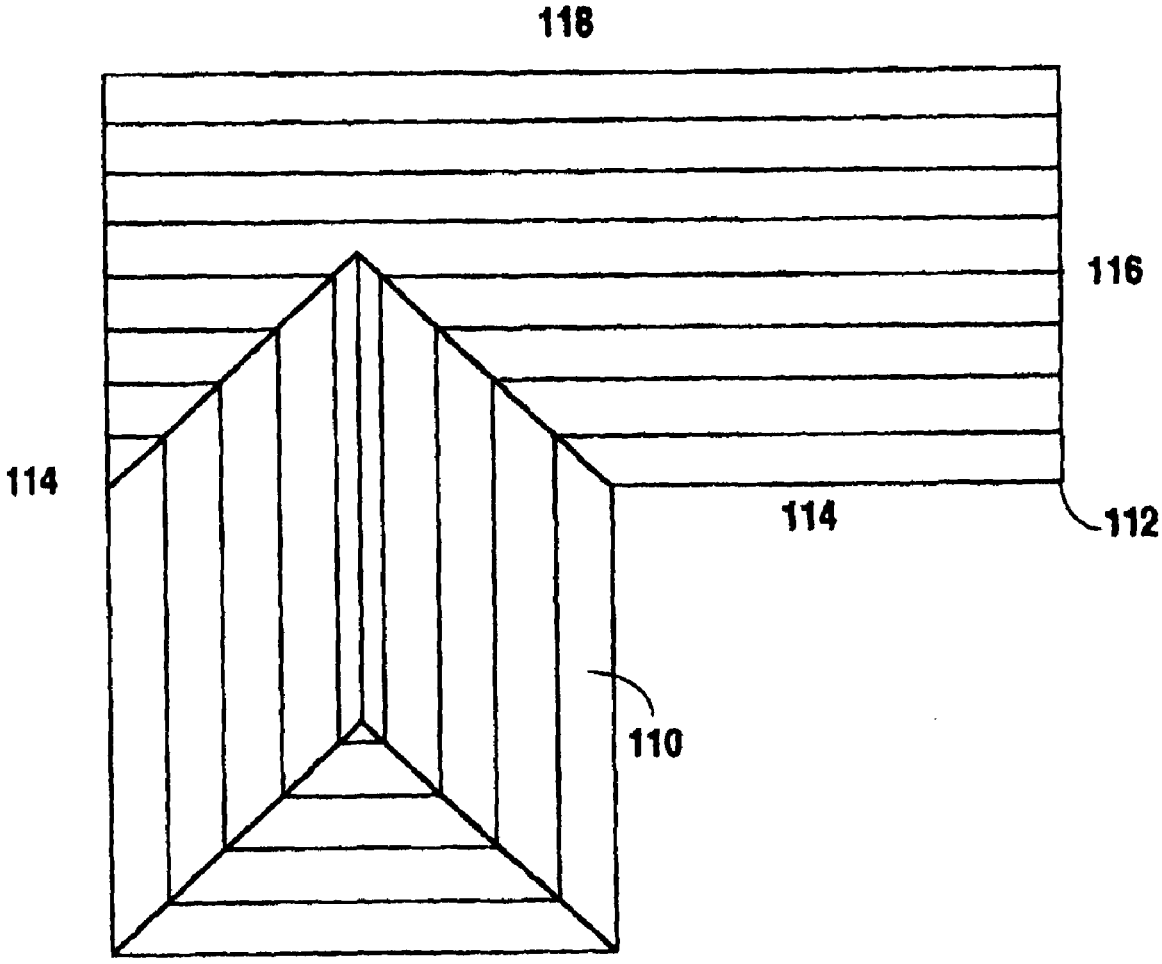
FIG. 3 is a top view of the roof deck illustrating placement of underlayment.

In FIG. 3 a top view of the roof deck 102 illustrating placement of underlayment 10 is shown. In this step of the present methodology, the user installs underlayment 110, which is preferably a poly(styrene-butadiene-styrene) (SBS) multipurpose or Type 30 per ASTM D226. During this step, the user will roll the underlayment 110 over the gable/rake edge 112 a preferred minimum of one inch. There is a preferred minimum headlap of two inches for the underlayment 110. This may be increased to a minimum of four inches in wet or snow areas. Headlap for purposes of this application is defined as the portion of slate 130 (See FIG. 6) overlapped by two layers of slate 130 (See FIG. 6) from the next two rows. Headlap facilitates making the roof watertight. Indeed, failure to adhere to the recommended headlap can lead to interior water damage. There is a preferred minimum six inch sidelap for the underlayment 110. For purposes of this application, sidelap is defined as side edges of adjoining pieces of underlayment. Nails (not shown) may be used to secure the underlayment 110 and have a pattern of preferably 12 inches on center at the headlap and preferably 36 inches on center at the center of the underlayment roll.

Figure 4:
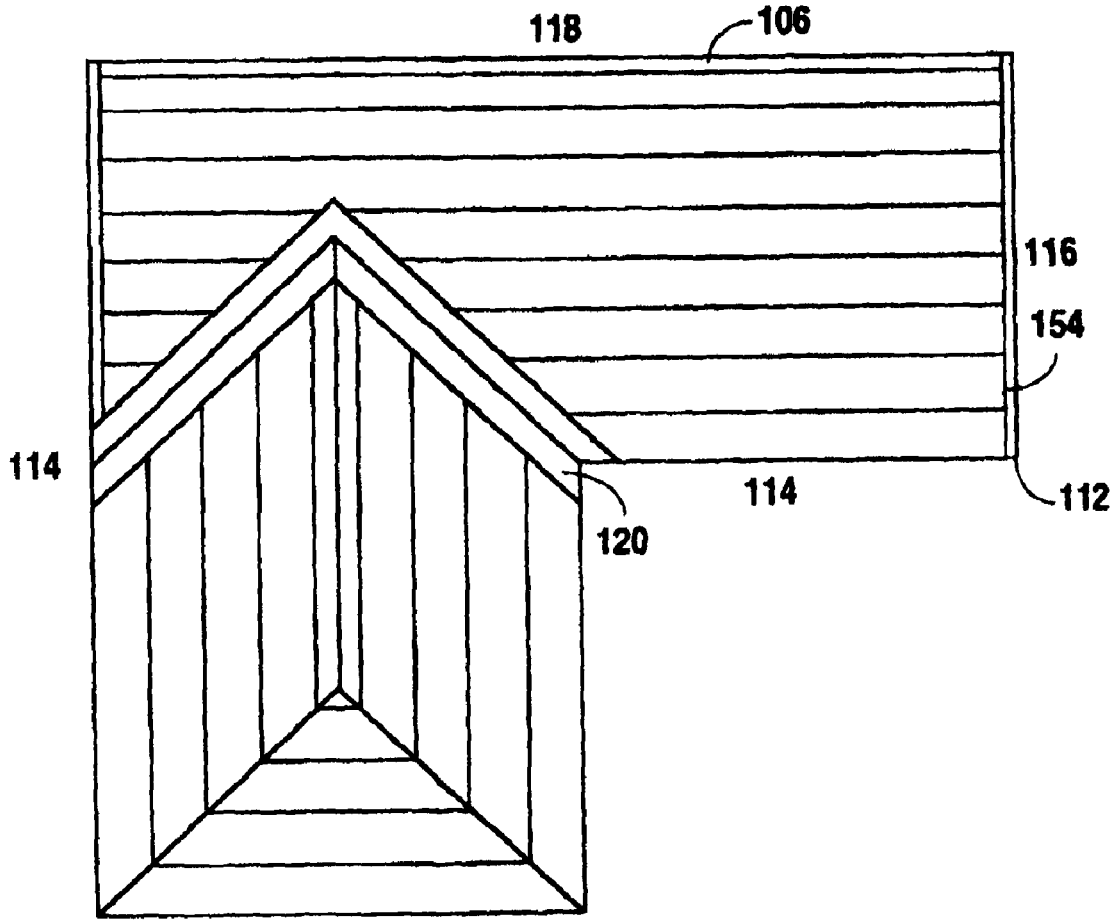
FIG. 4 is a top view of the roof deck illustrating placement of valley metals and rake edge metals.
Figure 16:
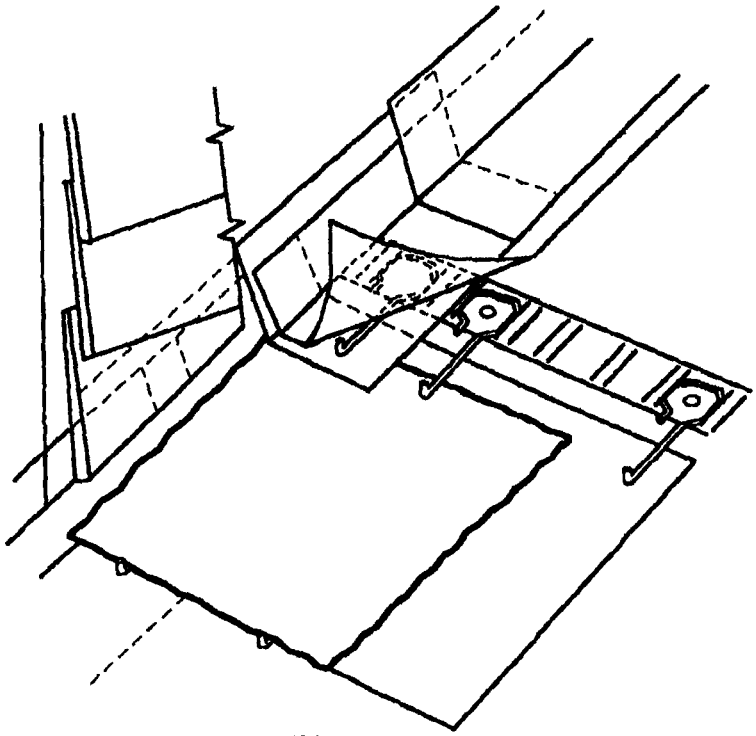
FIG. 16 is a perspective view of the roof deck illustrating flashing at siding.
Figure 17:
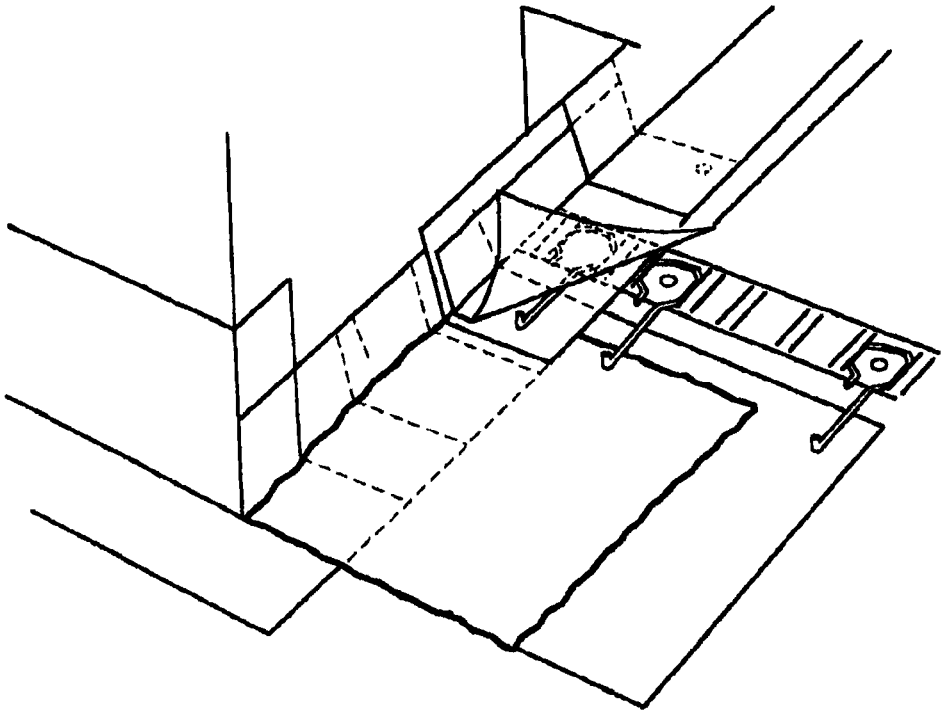
FIG. 17 is a perspective view of the roof deck illustrating flashing at sidewall/chimney.
Figure 18:
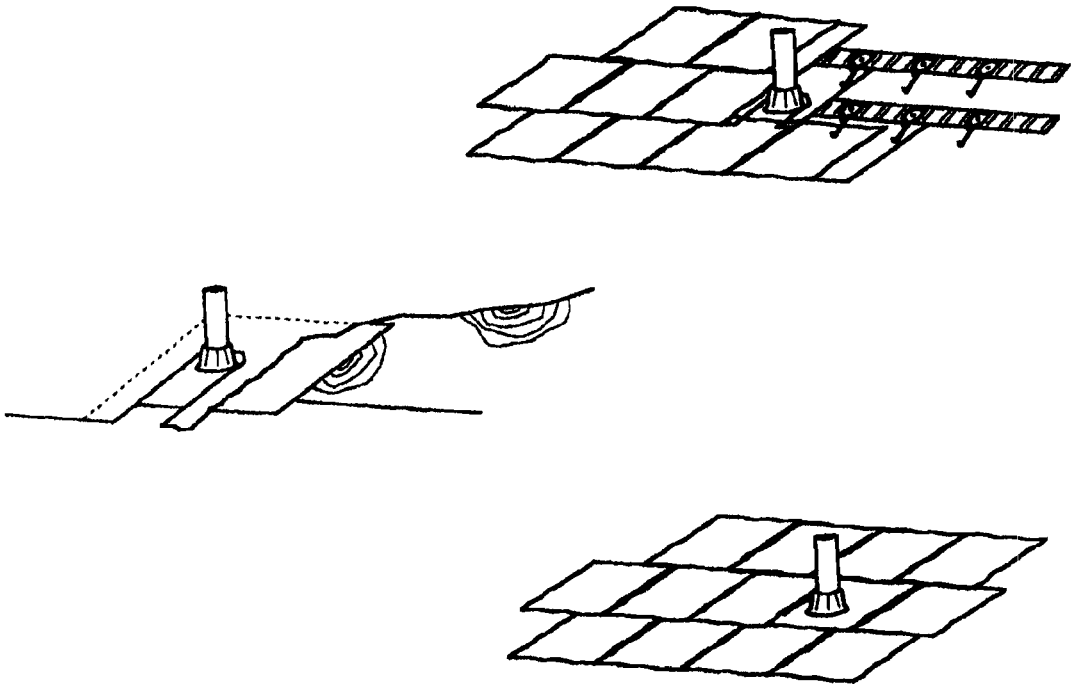
FIG. 18 is a perspective view of the roof deck illustrating plumbing vent details with installation.

FIG. 4 is a top view of the roof deck 102 illustrating placement of valley metals 120 and rake edge metals 154. In the present methodology, the user may install valley metal 120 over membrane 106 (See FIG. 2). This valley metal 120 is preferably 26 gauge galvanized, 24 inch "W", or 16 ounce copper metal. It is preferably installed with a one inch splash diverter (not shown) and preferably fastened with 1.25 inch roof nails or 1.25 inch copper slating nails one inch from the edge. The user may also install gable/rake edge metals 154 at gable/rake edge 112. The gable/rake edge metal 154 is preferably 26 gauge galvanized or 16 ounce copper metal. Next the user may install vertical wall flashings (See FIGS. 16 and 17) and plumbing stack and vent flashings (See FIG. 18). The vertical wall flashings (See FIGS. 16 and 17) are preferably 26 gauge galvanized or 16 ounce copper. At the next step, the user may install peel and stick membrane 106 over ridge 118. The membrane 106 used is preferably a self-adhering poly (styrene-butadiene-styrene) (SBS) type. The membrane 106 is preferably 12 inches wide having three inch endlaps.

Figure 5:
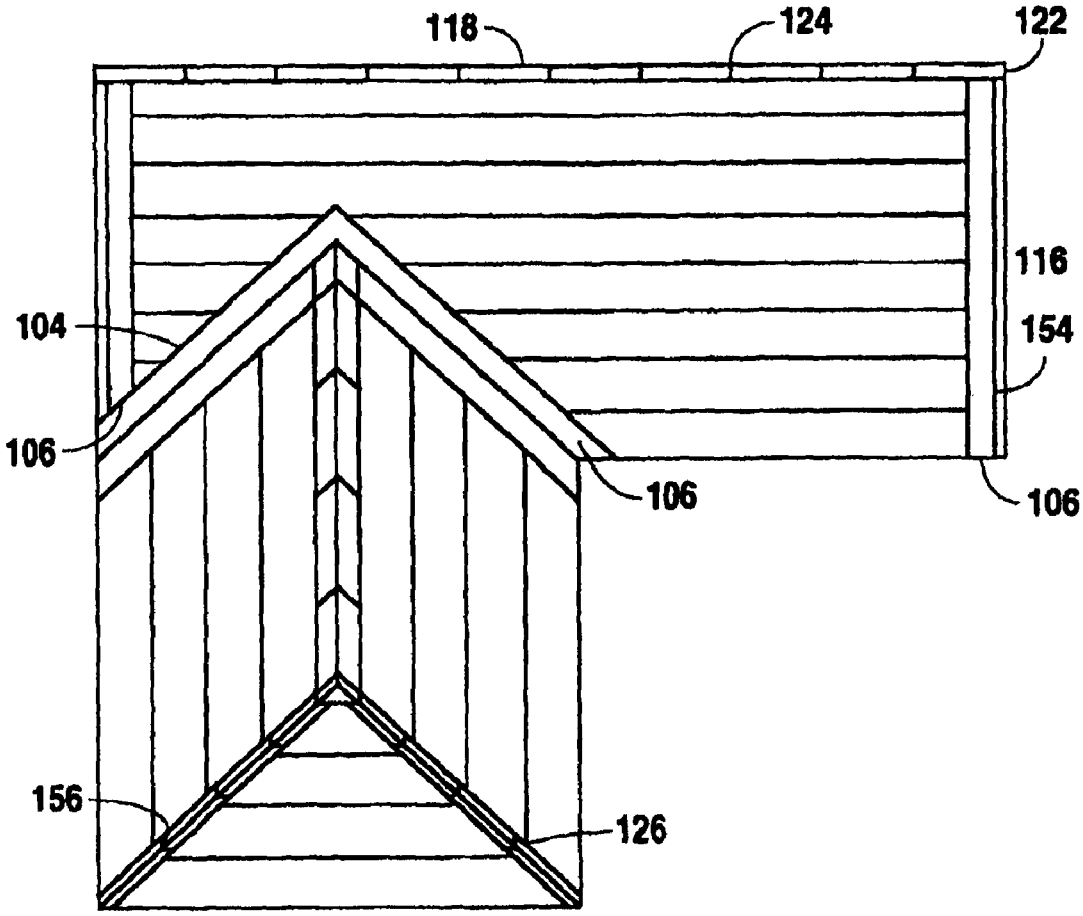
FIG. 5 is a top view of the roof deck illustrating preparation of all valleys, hips, ridges, walls and roof penetrations.

In FIG. 5 a top view of the roof deck 102 illustrating preparation of all valleys 104, hips 156, ridges 118, walls and roof penetrations is shown. Peel and stick membrane 106 is applied over valley metal 120 (See FIG. 4) leaving preferably three inches from the center line of valley 104 uncovered. The membrane 106 should cover valley metal 120 a preferred minimum of 11 inches on each side of the center line and cover nails a preferred minimum of three inches. With a utility knife, the user may cut preferably ten inch wide strips from the roll of peel and stick membrane 106. The user may install peel and stick membrane 106 over the gable/rake edge metal 154 being sure to cover all fasteners. The membrane 106 should extend a preferred minimum of six inches beyond the gable/rake edge metal 154 over the underlayment 110. This gable/rake edge metal 154 membrane 106 may also extend over the valley 104 membrane 106. The membrane 106 on the valley metal 120 and the gable/rake edge metal 154 may be self-adhered, instead of nailed. The membrane 106 should also be installed over all other flashings and roof penetrations a preferred minimum of six inches past all flashings. Next the user may install the hip spacer 126 and the ridge spacer 122 using preferably 1.5 inch roofing nails or coated decking screws. These fasteners are preferably placed at 24 inches on center on each side of the nailer. Spacer flashing 124 is cut from slate liner 140 (See FIG. 6) and placed over the ridge spacer 122 and should preferably overlap 12 inches at sidelaps.

Figure 6:
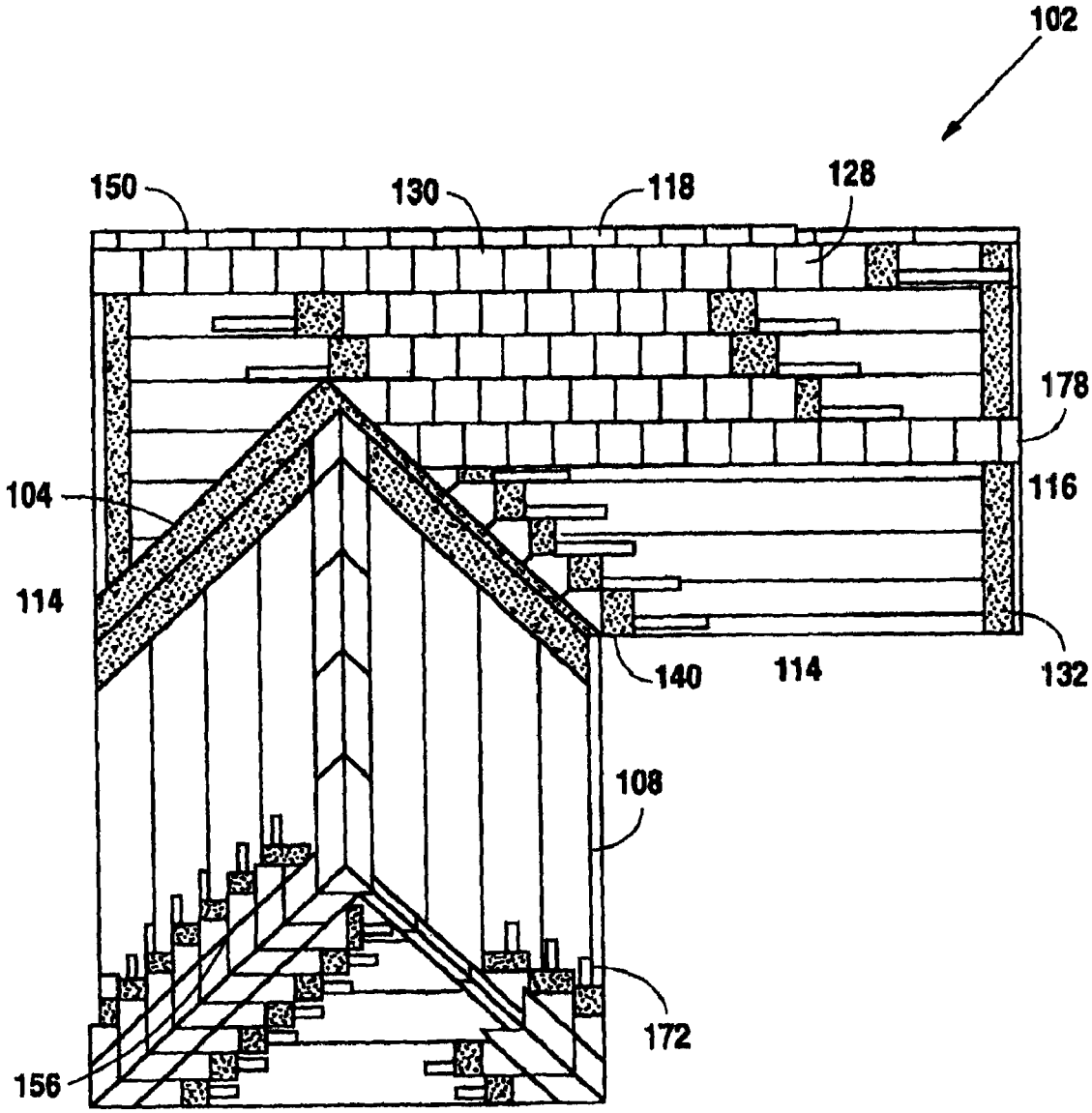
FIG. 6 is a top view of the roof deck illustrating the installation of slate.

FIG. 6 is a top view of the roof deck 102 illustrating the installation of slate 130. In the slate installation step, the roof deck 102 is outlined with slate 130. The hips 156, ridges 118 and valleys 104 are outlined first. Next the user wilt locate and mark the bottom batten row 172 at the drip edge 108. The bottom row 174 (See FIG. 7) of hangers 134 (See FIG. 7) should extend to the drip edge 108. The user may then use a chalk line and measuring tape to locate the remaining rows for battens 132. Battens 132 should be preferably installed at 10 inch intervals. The battens 132 are preferably galvanized or stainless steel. Stainless steel is generally used where coastal salt water corrosion is a concern. It is to be appreciated that batten 132 spacing may be increased or decreased to accommodate fraction spacing. The user may begin at the hips 156 and valleys 104 and work up the roof deck 102 installing a full batten 132, slate liner 140, and 2-3 slates 130 at each row, leaving the field clear to walk. Next, the user may locate and install top row battens 132, slate liner 140, and top row of slates 130 (ridge row 178), then install ridge slates 150. The ridge slates 150 should overlap and lock in the ridge row 178 of slates 130. The user may trim off any exposed slate liner 140 with a utility knife.

Figure 7:
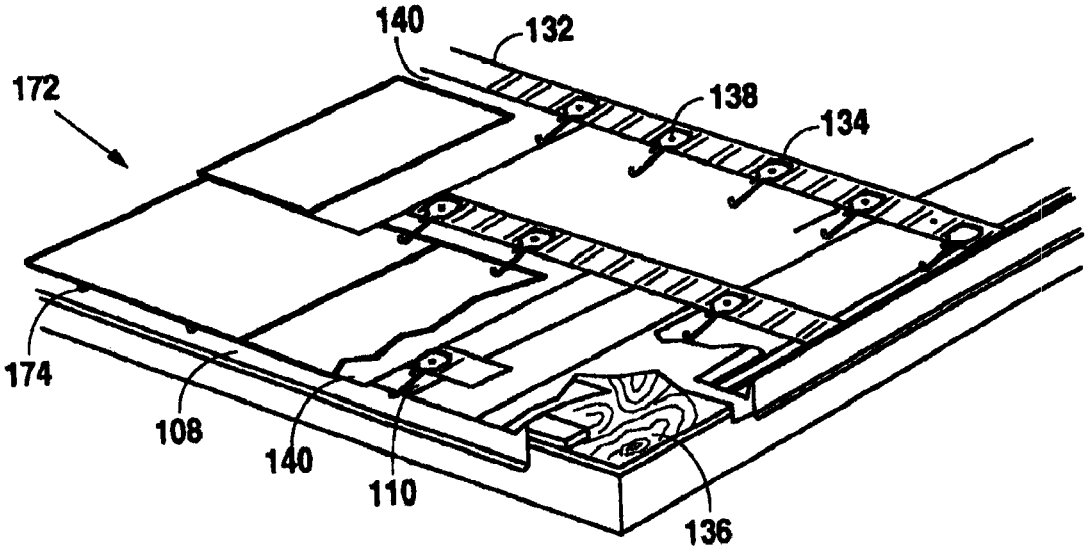
FIG. 7 is a perspective view of the roof deck illustrating installation of slate.
Figure 8:
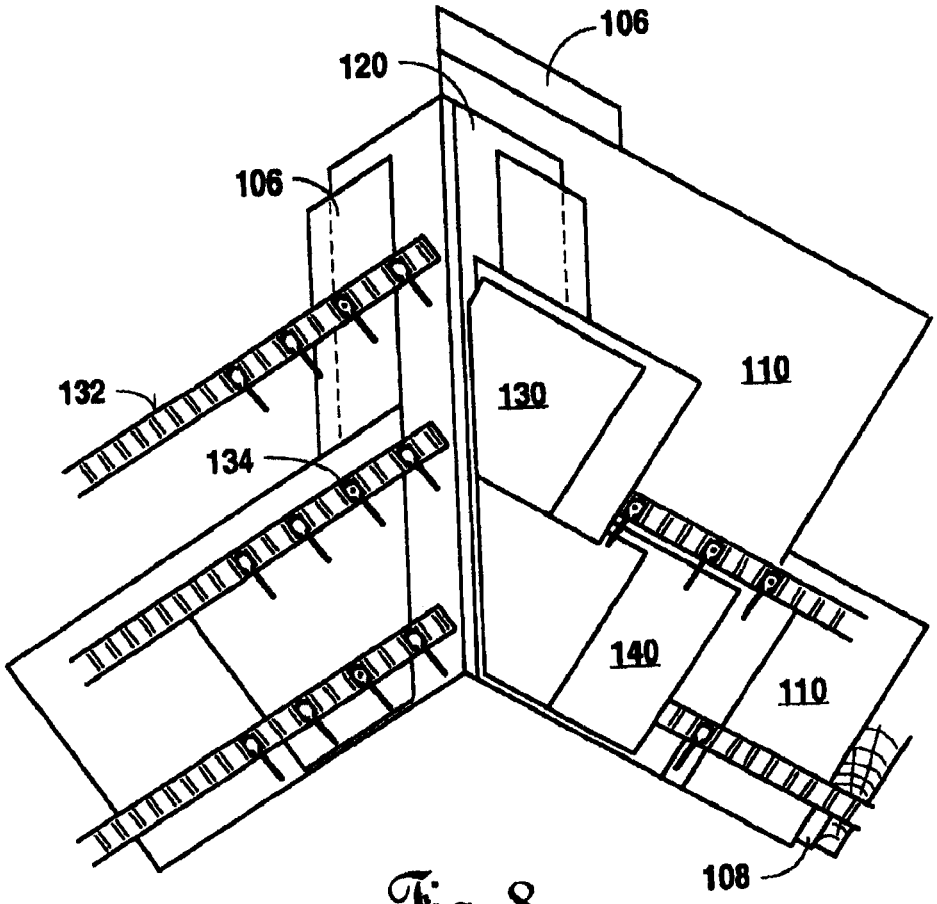
FIG. 8 is a perspective view of the roof deck illustrating slate installation at the valley.

In one embodiment, beginning four rows down from the ridge row 178 of slates 130, the user may install batten 132. Hangers 134 may or may not be preinstalled on battens 132. The user may then lay slate liner 140 on hangers 134 (See FIG. 7) and drop slate 130 onto hangers 134 (See FIG. 7). The hangers 134 (See FIG. 7) are preferably spring tempered stainless steel. The user is cautioned to confirm that the keyways or joints line up with the ridge row 178 of slate 130. Next the user may install the next row of battens 132 locking in the row of slate 130 below and repeating the process. In one embodiment, the user offsets the keyways ½ slate 130 every other row. The last row may be "shoehorned" in by the user. The user may then come down the roof four rows and repeat the process. A perspective view of this slate installation process is shown in FIG. 7 while FIG. 8 illustrates a perspective view of the slate installation at the valley 104. Greater detail on the slate 130 installation is show in FIGS. 12-15.

Figure 9A:
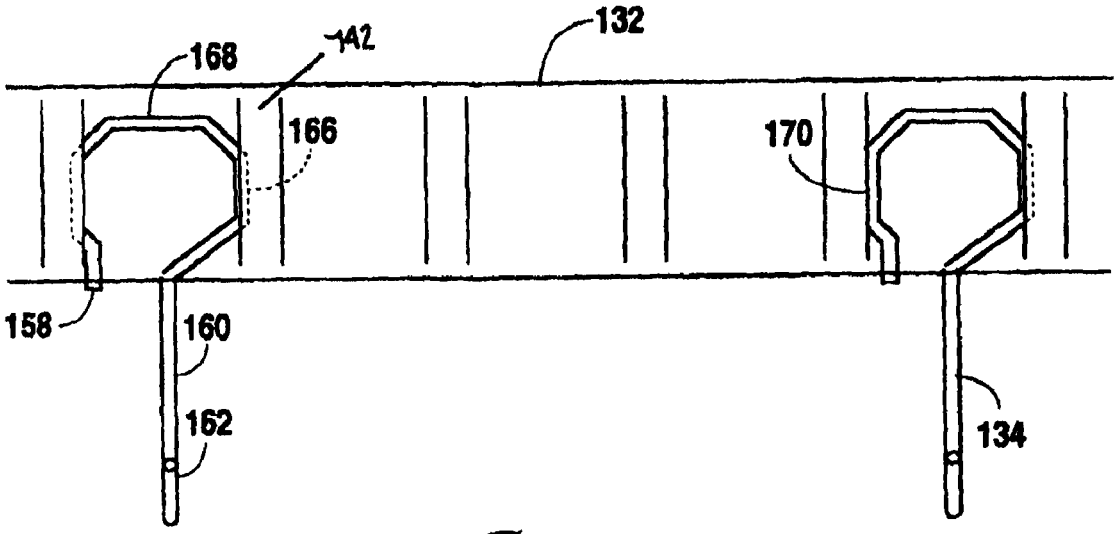
FIG. 9A is a top view of a batten with exemplary hangers used according to the present disclosure.
Figure 19A:
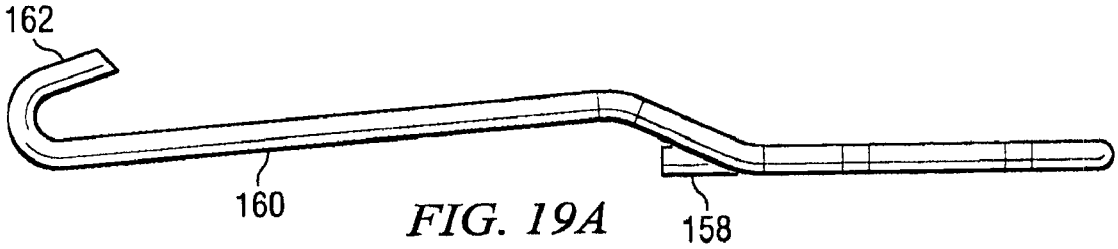
FIG. 19A is a side view of the hanger according to one aspect of the present disclosure.
Figure 19B:
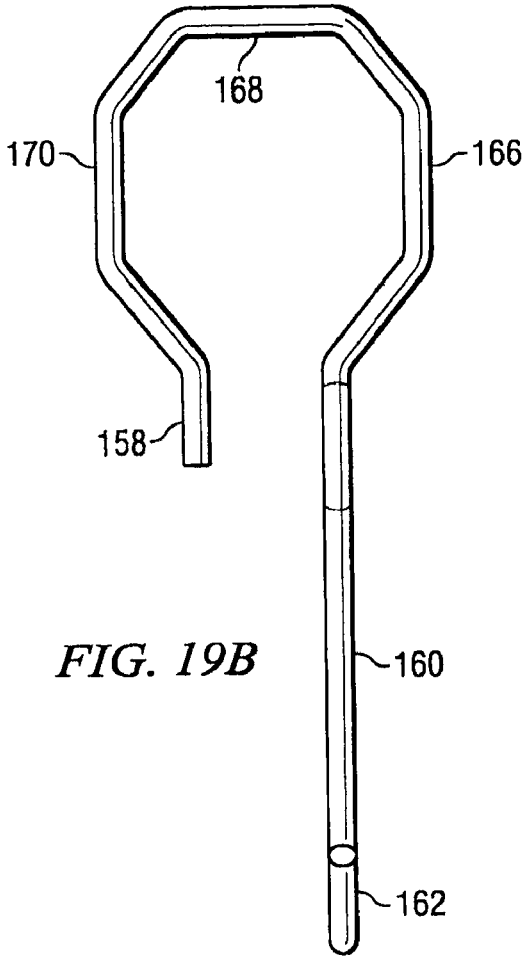
FIG. 19B is a plan view of the hanger of FIG. 19A.

In FIG. 9A a top view of batten 132 with hangers 134 used in the present methodology is shown. Hangers 134, which are preferably formed of spring tempered stainless steel, can be easily installed and removed to facilitate proper support for the slate 130. The hangers 134 provide a convenient way to quickly and easily install and remove individual slate 130. In one embodiment illustrated in FIG. 9A, the hangers 134 have a short member 158 and a long member 160. The long member 160 has a curved distal end (upward facing hook 162 at one end) and the remaining end is adjacent to a first outward extending arm 166. In some embodiments, the long member 160 may be modified to include a wider distal end or two distal ends. The first outward extending arm 166 is adjacent a central connecting member 168. This central connecting member 168 is adjacent a second outward extending arm 170. This second outward extending arm 170 is adjacent the short member 158. While the majority of hanger 134 rests in one plane, long member 160 extends at an angle above the plane of first outward extending arm 166, curves downward at an angle and ends at a point within the linear plane of the first outward extending arm 166. This exemplary embodiment is illustrated in more detail in FIGS. 19A and 19B. When installing the hanger 134, the user will insert the second outward extending arm 170 of the hanger 134 into an opening formed by a first hanger holder 142. The hanger holder 142 is generally defined by the batten 132 to be a pocket or slot-like receiving portion for receiving a portion of the hanger 134. The hanger holder 142 may be formed as an integral portion of the batten 132, or as a separable element attached to the batten. The first outward extending arm 166 of hanger 134 will then be inserted into an opening formed by an adjacent hanger holder 142. When removing the hanger 134, the user squeezes together the short member 158 and long member 160 to remove the hanger 134 from the first hanger holder 142 and the adjacent hanger holder 142.

Figure 9B:
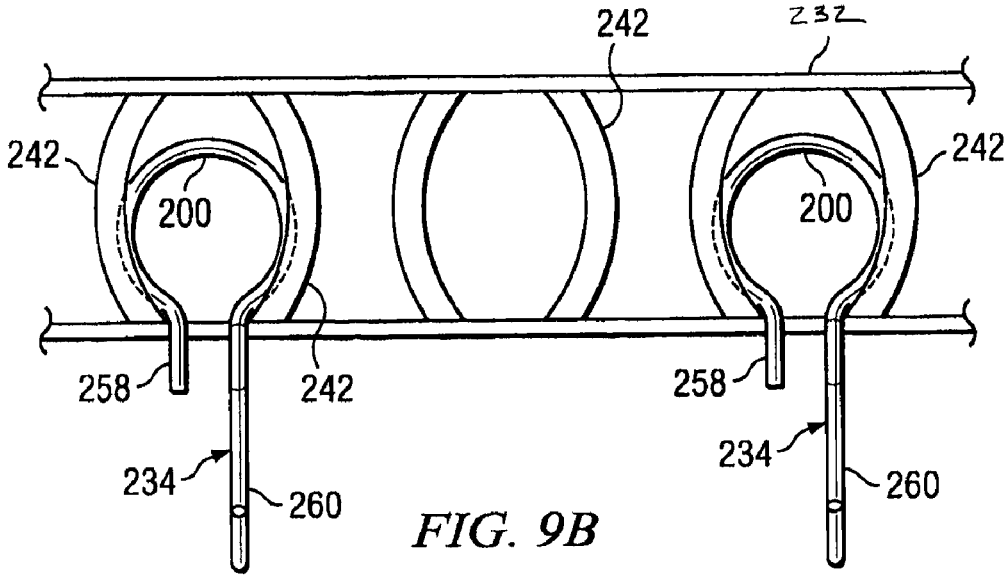
FIG. 9B is a top view of a batten with exemplary hangers used according to the present disclosure.

It is to be appreciated that the hanger 134 may take a variety of shapes and configurations for interacting with the battens 132 and retaining the slate members on the roof. Indeed, the hanger holders may be correspondingly altered to take a shape and size corresponding to, or otherwise accommodating, the various hanger shapes and sizes. For example, with reference to FIG. 9B, a head portion 200 of a hanger 234 may take on a circular or substantially circular configuration. A batten 232 may be provided such that a pair of hanger holders 242 are contoured to correspond to the shape of the head portion 200 of the hanger 234. The hanger 234 may further include a short member 258 and long member 260 to facilitate insertion of the hanger 234 into the hanger holders 242 in a manner similar to that described with reference to FIG. 9A.

Figure 9C:
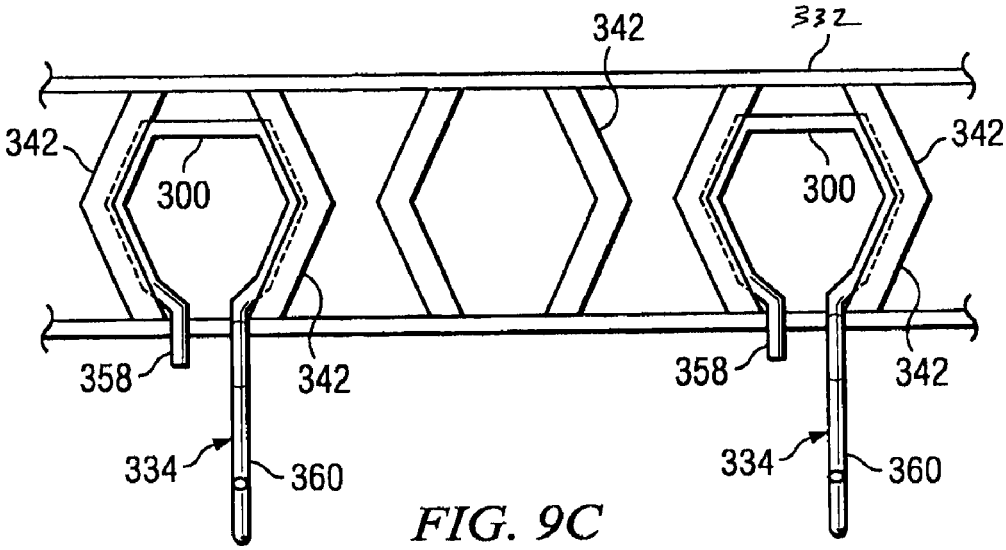
FIG. 9C is a top view of a batten with exemplary hangers used according to the present disclosure.

In another embodiment depicted in FIG. 9C, a head portion 300 of a hanger 334 may be formed to have a hexagonal or substantially hexagonal shape. Corresponding hanger holders 342 may be provided to correspond to the shape of the head portion 300 of the hanger 334. Indeed, in some embodiments, the hanger holders 342 may include gaps at the apices of the hanger holders to permit extension of the hexagonal head 300 through the hanger holder when removably secured thereto. The hanger 334 may further include a short member 358 and long member 360 to facilitate insertion of the hanger 334 into the hanger holders 342 in a manner similar to that described with reference to FIG. 9A.

It is to be appreciated that additional embodiments are contemplated in which the head portion of the hanger is sized and shaped to fit into corresponding receiving portions (such as the exemplary hanger holders described above) of the batten, thereby permitting the retention of slate on a roof structure. In such embodiments, the hangers may be removably secured to the battens, thereby permitting hangers to be movable or repositionable along the length of the battens. This provides flexibility in deciding where to establish hangers along the length of the battens. Indeed, larger slate tiles may require a larger number of hangers, whereas smaller slate tiles may require a lesser number of hangers. Accordingly, efficiency of resources can be maximized according to the teachings of the present disclosure. The removably securable relationship between the hangers and the battens also permits quick installation of the roofing system of the present disclosure.

Figure 9D:
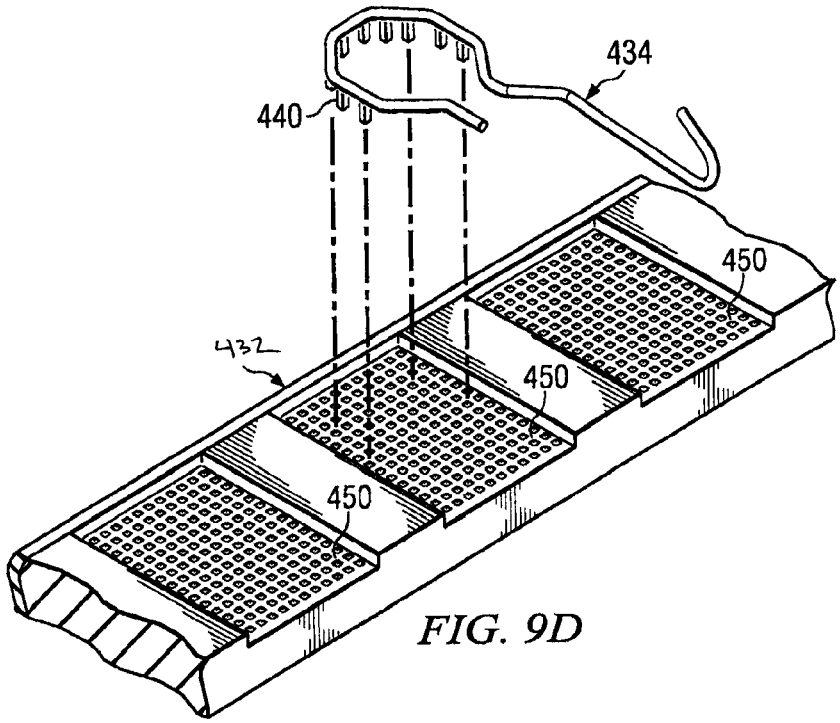
FIG. 9D is a perspective view of a batten with exemplary hanger used according to the present disclosure.
Figure 9E:
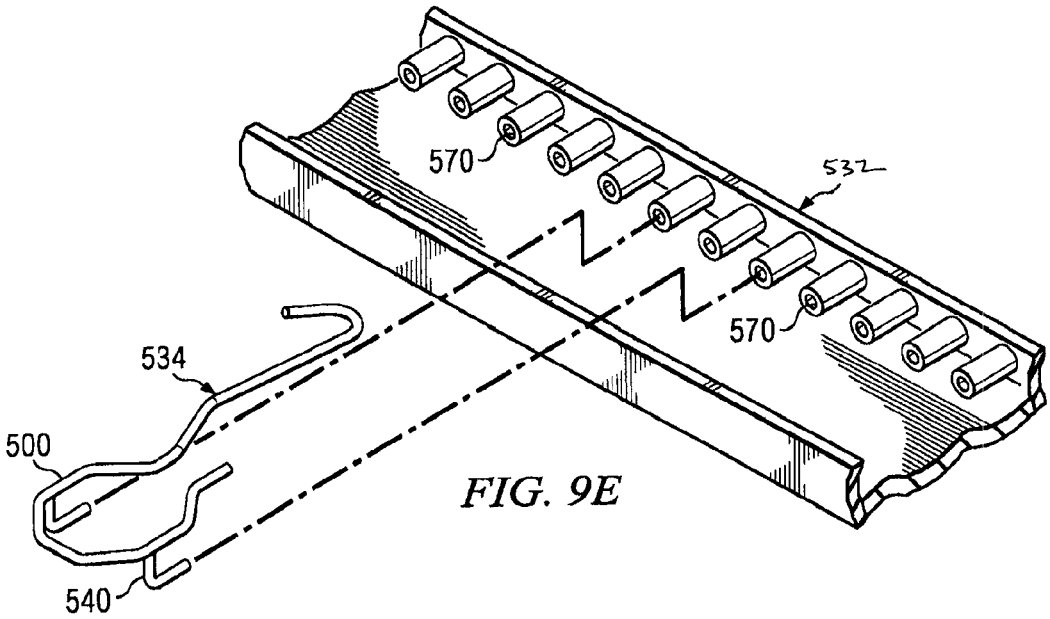
FIG. 9E is a perspective view of a batten with exemplary hanger used according to the present disclosure.

Additional exemplary embodiments are contemplated in which the head portion of the hanger is shaped and sized to fit into, snap into, or otherwise removably attach to, the corresponding receiving portions (e.g., hanger holders) defined in the batten. For example, with reference to FIG. 9D, a head portion 400 of a hanger 434 may include projections 440 shaped and sized to snap-fit into a corresponding grid-like structure 450 (receiving portion) of a batten 432. Of course, any number of projections 440 are contemplated, so long as they are able to snap-fit, or otherwise attach to, the batten 132. Still further, in FIG. 9E, a head portion 500 of a hanger 534 may include a pair of projections 540 designed to fit into corresponding receptacles 570 of a batten 532. In such an embodiment, the projections 540 of the hanger 534 may be substantially L-shaped so as to minimize the distance the projections extend from the head portion 500. Indeed, the projections 540 may be fixed or actuateable from a first position to a second position. Of course, the projections 540 may take any shape to permit operative engagement of the hanger 534 with the batten 532.

Figure 10:
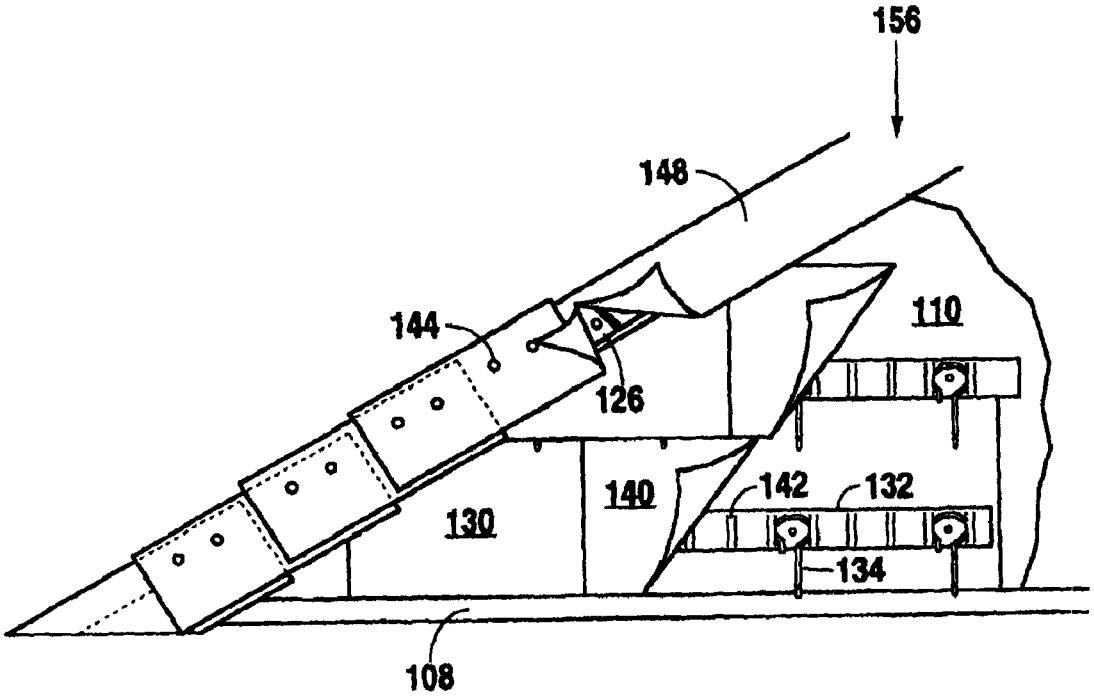
FIG. 10 is a front view of the roof deck illustrating hip installation of slate.

FIG. 10 is a front view of the roof deck 102 illustrating hip 156 installation of state 130. The hips 156 of the roof deck 102 are one of the first areas outlined with state 130. The user will install battens 132 on top of the underlayment 110. Hangers 134 are inserted into hanger holders 142 of battens 132. The user will lay slate liner 140 on hangers 134 and drop slate 130 onto hangers 134. At the hips 156, hip spacer 126 is applied followed by hip spacer cover 148. Slate trim pieces 146 are applied and attached to hip 156 by decking screws 144.

Figure 11:
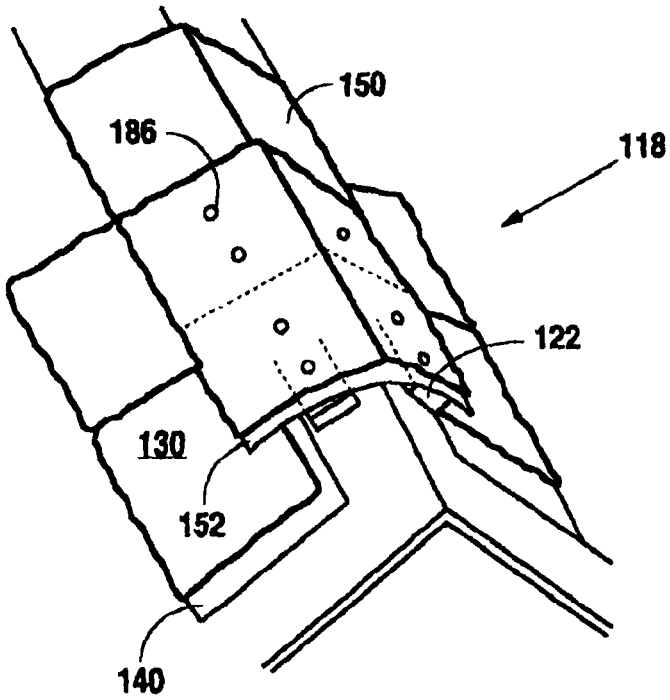
FIG. 11 is a top view of the roof deck illustrating the ridge.
Figure 12:
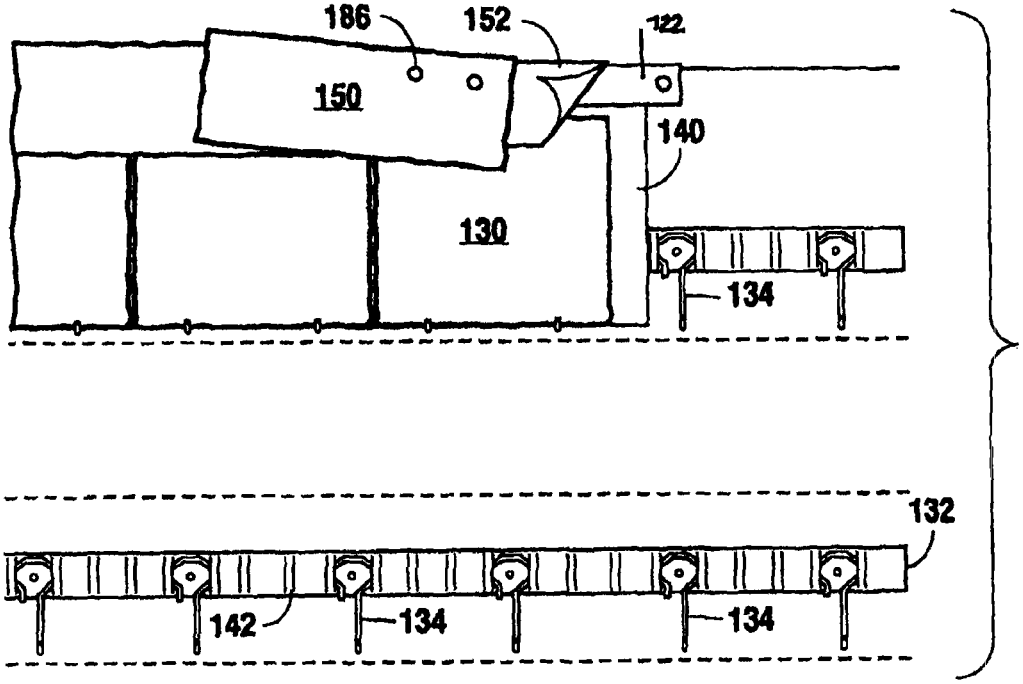
FIG. 12 is a side view of the roof deck illustrating ridge installation of slate.

In FIG. 11 a top view of the roof deck 102 illustrating the ridge 118 installation is shown. With the ridge 118 installation step, the user will install ridge spacers 122 by making sure the ridge spacer 122 is preferably evenly spaced over the ridge 118 and fastened at preferably 24 inches on center along each side of ridge 118 with preferably 1.5 inch roofing nails or screws. The user will place preferably 13 inch wide slate liner 140 over the ridge spacers 122 so that the center line of slate liner 140 is centered along the ridge 118. It is preferred to work with 10-12 foot lengths being sure to preferably overlap end joints 12 inches minimum. Next, the user installs top batten 132 (See FIG. 12) along a chalk line using a nail gun and preferably 1.25 inch 0.120 galvanized standard coil fed roofing nails. Hangers 134 (See FIG. 12) are inserted into hanger holder 142 (See FIG. 12) of battens 132 (See FIG. 12). In some embodiments, the batten 132 (See FIG. 12) is fastened at the center of the hanger 134 (See FIG. 12) except at the gable/rake edges 112 (See FIG. 4). The user lays the slate liner 140 along row of hangers 134 (See FIG. 12) and tucks under the plastic ridge spacer cover 152. The ridge spacer cover 152 should preferably overlap top row of slate liner 140 by a minimum of three inches. The user will next lay the first row of slate 130 by placing bottom edge of each slate 130 into top row of hangers 134 (See FIG. 12). The hangers 134 (See FIG. 12) are preferably preinstalled at six inches center. The slates 130 are preferably twelve inches wide by twelve inches long standard quarried slate. Of course, other spacing dimensions for the hangers 134 and other sized slates 130 are contemplated to fall within the scope of the present disclosure. Also, it is to be appreciated that other tiles other than slate may be used in accordance with the principles of the present disclosure. Indeed, it is contemplated that any roofing or siding members may be used in accordance with the principles herein. The hangers 134 (See FIG. 12) are preferably evenly spaced on the slate 130. Each hanger 134 (See FIG. 12) should be preferably three inches from the edge of each full piece of slate 130. On smaller pieces, it is preferable to have at least two hangers 134 (See FIG. 12) are supporting each piece of slate 130. Hanger 134 (See FIG. 12) can be easily removed and replaced to facilitate spacing up to preferably 1.5 inches. In some embodiments, if a measurement calls for a piece of slate 130 less than four inches wide, the adjacent piece should be cut back so that the small piece is preferably a minimum of four inches. The cut edges can be placed side by side so that the cut edge disappears and is not distinguishable. The user preferably ensures that the ridge spacer cover 152 overlaps the top row of slate 130 a preferred minimum of two inches. The top edge of the top row of slate 130 is preferably no more than one inch from the bottom of the ridge spacer 122. The ridge trim pieces 150 are installed by nailing or screwing each piece of state 130 through two predrilled holes 186 directly through the ridge spacer 122 into the roof deck 102. The trim pieces 150 are preferably 16 inch.times.7 inch standard quarried slate predrilled. The edge of each trim piece 150 must meet at the top of the ridge 118 and one piece should slightly overlap the other so that a clean, weather resistant joint is formed. If desired, the user may apply a weatherproof caulk of a matching color to the joint. The caulk is preferably a high quality exterior grade silicone. Next, the next ridge trim piece 150 is installed by overlapping the previously installed piece by preferably six inches. If desired, each nail hole can be covered with a weatherproof caulk. The ridge trim pieces 150 should overlap the top of the first row of state 130 by a preferred minimum of two inches. Care should be taken not to overdrive the fasteners on ridge trim pieces 150. The slates 130 should be able to wiggle slightly. Any plastic ridge spacer cover 152 that is visible after the ridge trim pieces 150 are installed can be carefully trimmed with a utility knife. FIG. 12 is a side view of the roof deck 102 illustrating ridge 118 installation of slate 130.

Figure 13:
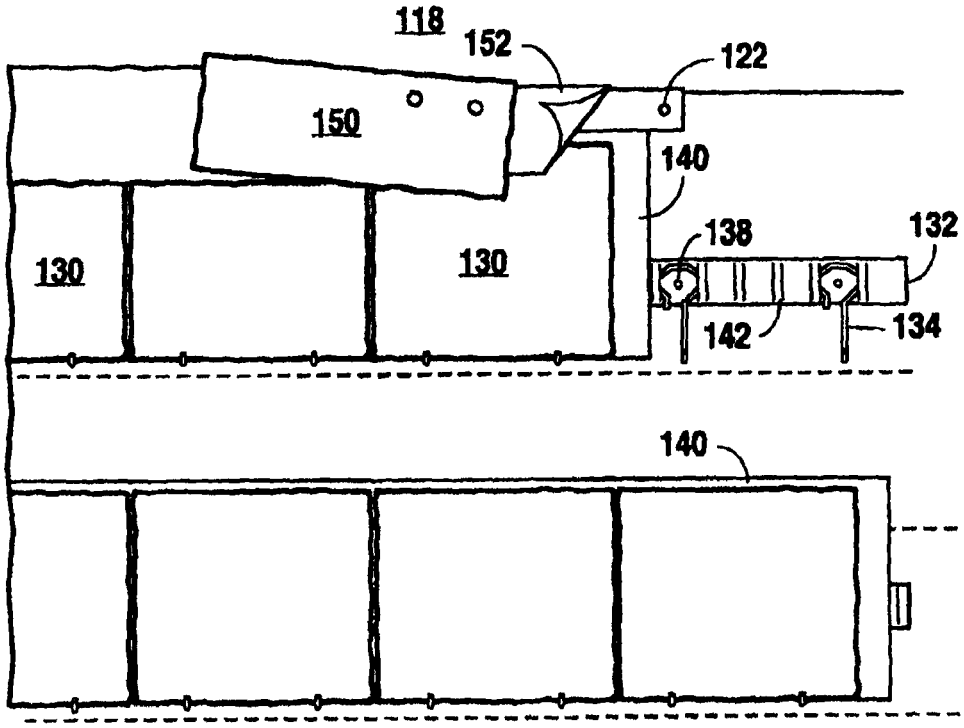
FIG. 13 is a detailed view of slate installation step 1.

In FIG. 13 a detailed view of exemplary slate 130 installation step 1 is shown. In installation step 1, the user installs battens 132 end to end on a fourth chalk line from the top or ridge 118. The user fastens each batten 132 with roofing nails 138 at the center of each hanger 134 approximately every six inches. The slate liner 140 is next installed by placing it along the row of battens 132 using the hangers 134 to support the slate liner 140. It is recommended that each piece of slate liner 140 be preferably a maximum of 25 feet long. The pieces of slate liner 140 should preferably overlap a minimum of twelve inches at side laps. Slate liner 140 should be installed with the dull finish side up or shiny side down. In some embodiments, no nails are driven through the slate liner 140. Next the user installs slates 130 by placing slates 130 on the hangers 134 being careful to keep hangers 134 centered on the slates 130. In some embodiments, each slate 130 should have two hangers 134 supporting it preferably evenly spaced from each side edge of the slate 130. Full slates 130 should have a hanger 134 preferably three inches from each side edge. At the beginning or end of each row a one-half slate offset is recommended and can be achieved by placing additional hangers 134 at the hanger holders 142 provided in the battens 132. The battens 132 can be cut with tin snips. The user should align the battens 132 end to end preferably maintaining a six inch space between the hangers 134 for slates 130 (or three empty hanger holders 142 in the battens 132). Battens 132 should be held back ½ inch from ridge spacers 122 or gable/rake edge metals 154 (See FIG. 5).

Figure 14:
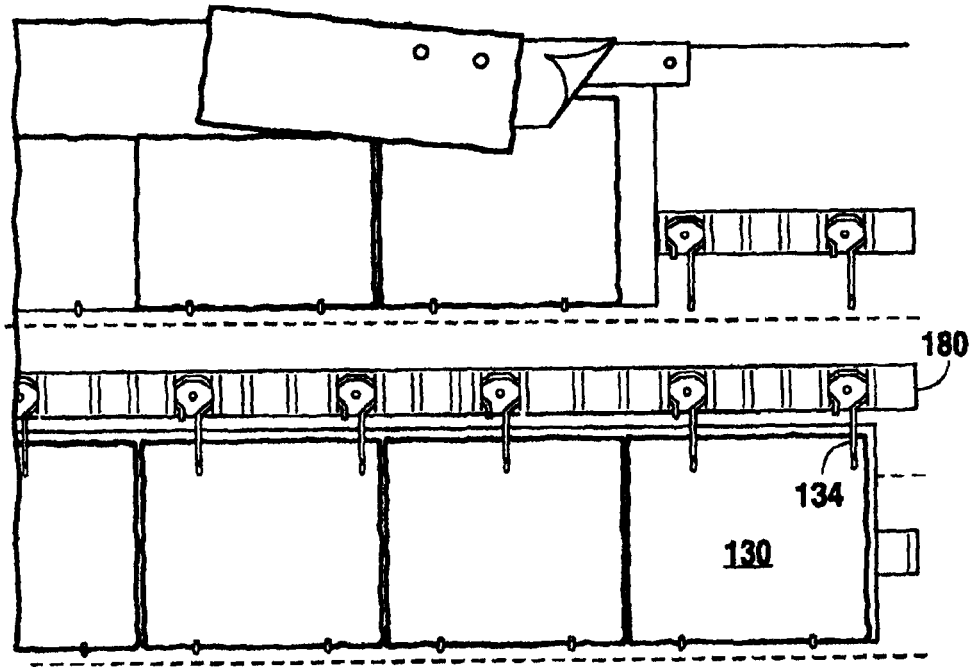
FIG. 14 is a detailed view of state installation step 2.

FIG. 14 is a detailed view of exemplary slate 130 installation step 2. In this step of installation, the user will install the next row 180 of battens 132. The battens 132 should lock into the slates 130 below. The user should ensure the hangers 134 are preferably evenly spaced on the states 130 below. The hangers 134 should be preferably three inches from each edge of each slate 130. Tin snips are used to trim the battens 132 at the ends to facilitate hanger 134 spacing.

Figure 15:
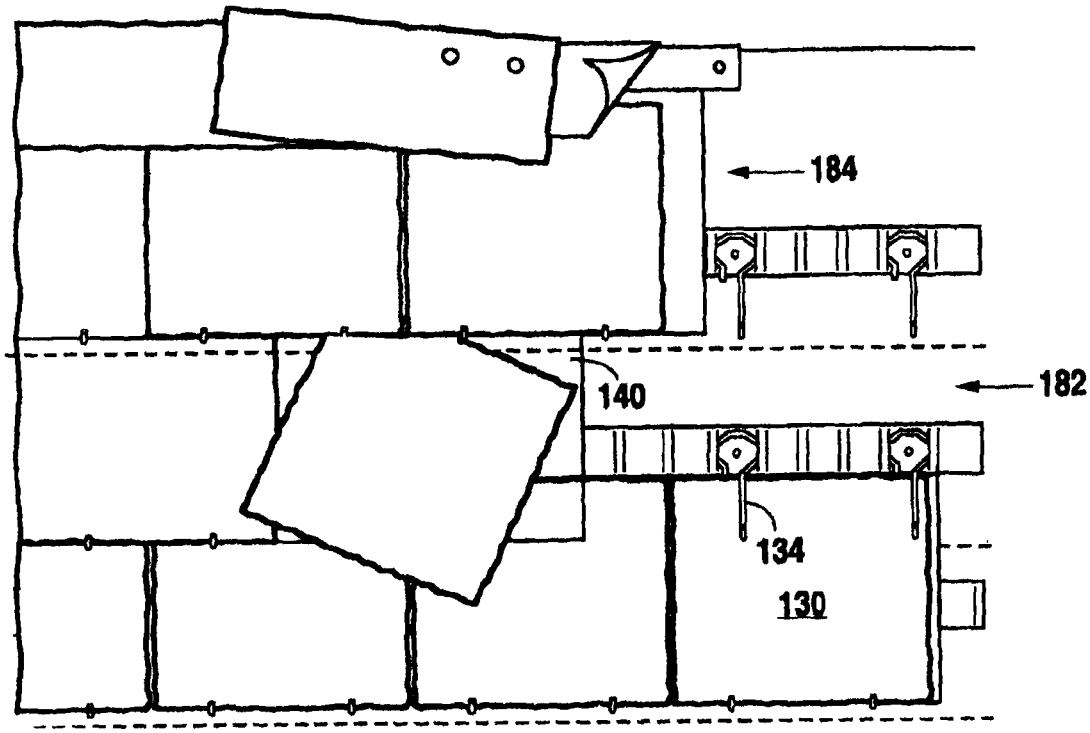
FIG. 15 is a detailed view of state installation step 3.

In FIG. 15 a detailed view of exemplary slate 130 installation step 3 is shown. In this step of installation, at the top row of each working section an open row 182 is created. To complete the installation of the open row 182, the user should install slate liner 140 by slipping it under the top row 184 of slate 130. The bottom edge of the slate liner 140 is held in place by hangers 134. Next the user installs the slates 130 by slipping the top edge of the slate 130 under the top row 184 until the bottom edge of the slate 130 clears the hangers 134 below. The user pulls or pushes the slate 130 downward slightly until the hangers 134 support the bottom edge of the slate 130. Preferably an 18 inch wide piece of slate liner 140 can be used as a shoehorn by inserting it first, then the slate 130 slides easier into place. The shoehorn is removed and the process is repeated.

While various embodiments in accordance with the principles disclosed herein have been described above, it should be understood that they have been presented by way of example only, and not limitation. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called field. Further, a description of a technology in the "Background" is not to be construed as an admission that certain technology is prior art to any invention(s) in this disclosure. Neither is the "Brief Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What I claim is:

1. A system for supporting roofing members on a roof structure, comprising:
   - at least one batten extending along a portion of a roof structure, the batten having receiving portions comprising opposing openings formed through the at least one batten; and
   - a plurality of hanger devices, the hanger devices having head portions having opposing sides wherein each side is removably secured within a separate opening of the opposing openings of the receiving portions.

2. A system according to claim 1, wherein the head portion and the receiving portions have corresponding shapes.

3. A system according to claim 1, wherein the head portion is substantially octagonal, and the receiving portion is correspondingly shaped.

4. A system according to claim 1, wherein the hanger further includes a short member and a long member extending from the head portion, the short and long members cooperating to permit insertion of the head portion into the receiving portion.

5. A system according to claim 4, wherein the long member includes a curved distal end.

6. A system according to claim 1, further comprising an interlayment member disposed over the hanger devices.

7. A system according to claim 1, wherein the head portion is substantially circular, and the receiving portion is correspondingly shaped.

8. A system according to claim 1, wherein the head portion is substantially hexagonal, and the receiving portion is correspondingly shaped.

9. A system according to claim 8, wherein at least one of the opposing openings in the receiving portion includes an apex thereof, a portion of the hanger device extending through the apex.

10. A system for supporting roofing members on a roof structure, comprising:
   - at least one batten extending along a portion of the roof structure, the batten having receiving portions comprising opposing openings formed through the at least one batten;
   - a plurality of hanger devices, the hanger devices having head portions having opposing sides wherein each side is removably secured within a separate opening of the opposing openings of the receiving portions, each hanger device further having a member extending from the head portion, the member having a curved distal end; and
   - an interlayment member disposed under the roofing members and over the hanger devices such that a portion of the interlayment member abuts the distal end of the member.

11. A system according to claim 10, wherein the receiving portions and head portions have corresponding shapes.

12. A system according to claim 10, wherein the head portion is substantially octagonal, and the receiving portion is correspondingly shaped.

13. A system according to claim 10, wherein the member is a long member, and wherein the hanger further includes a short member, the short and long members cooperating to permit insertion of the head portion into the receiving portion.

14. A system according to claim 13, wherein the short member is spaced from and substantially parallel to the long member.

15. A system according to claim 10, wherein the head portion is substantially circular, and the receiving portion is correspondingly shaped.

16. A system according to claim 10, wherein the head portion is substantially hexagonal, and the receiving portion is correspondingly shaped.

17. A system according to claim 16, wherein at least one of the opposing openings in the receiving portion includes an apex thereof, a portion of the hanger device extending through the apex.

18. A method for assembling roofing members on a roofing structure, comprising:

securing a batten to a roof, the batten having receiving portions comprising opposing openings formed through the at least one batten;

providing a plurality of hanger devices, the hanger devices having a head portion having opposing sides, and a member extending from the head portion;

inserting the opposing sides of the head portions of the hanger devices into the receiving portions wherein each side is removably secured within a separate opening of the opposing openings of the receiving portions; and disposing roofing members over the batten and in engagement with the hanger device extending members.

19. A method according to claim 18, further comprising removing a hanger device from a receiving portion, and inserting the hanger device into an adjacent receiving portion.

* * * * *